US010094364B2

(12) United States Patent
MacHarg

(10) Patent No.: US 10,094,364 B2
(45) Date of Patent: Oct. 9, 2018

(54) BANDED CERAMIC VALVE AND/OR PORT PLATE

(71) Applicant: Ocean Pacific Technologies, Ventura, CA (US)

(72) Inventor: John P. MacHarg, Ventura, CA (US)

( * ) Notice: Subject to any disclaimer, the term of this patent is extended or adjusted under 35 U.S.C. 154(b) by 829 days.

(21) Appl. No.: 14/667,501

(22) Filed: Mar. 24, 2015

(65) Prior Publication Data

US 2016/0281505 A1 Sep. 29, 2016

(51) Int. Cl.
*F04B 1/20* (2006.01)

(52) U.S. Cl.
CPC ..... *F04B 1/2021* (2013.01); *F04B 1/2028* (2013.01); *F04B 1/2035* (2013.01); *F05C 2203/08* (2013.01)

(58) Field of Classification Search
CPC .. F04B 1/2007; F04B 1/2021; F04B 27/0817; F04B 27/0839; F04B 39/1066
See application file for complete search history.

(56) References Cited

U.S. PATENT DOCUMENTS

| | | | | |
|---|---|---|---|---|
| 2,948,555 A | | 8/1960 | Wright | |
| 3,178,241 A | | 4/1965 | Braunagel | |
| 3,601,012 A | * | 8/1971 | Oram | F01B 3/0041 91/499 |
| 3,614,061 A | | 10/1971 | Fitzpatrick | |
| 3,782,735 A | | 1/1974 | Novosad | |
| 4,033,550 A | | 7/1977 | Wheatley | |
| 4,732,047 A | | 3/1988 | Kato | |
| 4,739,738 A | | 4/1988 | Sander | |
| 5,013,219 A | | 5/1991 | Hicks | |
| 5,038,673 A | | 8/1991 | Schulze | |
| 5,102,310 A | | 4/1992 | Gander | |
| 5,392,693 A | | 2/1995 | Engel | |
| 5,520,088 A | | 5/1996 | Dixen | |
| 5,540,139 A | | 7/1996 | Martensen | |
| 5,554,009 A | | 9/1996 | Ohta | |
| 5,573,380 A | * | 11/1996 | Martensen | F04B 1/2021 417/269 |
| 5,584,228 A | | 12/1996 | Jepsen | |

(Continued)

FOREIGN PATENT DOCUMENTS

| | | |
|---|---|---|
| GB | 2190799 A | 11/1987 |
| JP | H0527286 | 4/1993 |

(Continued)

OTHER PUBLICATIONS

International Search Report and Written Opinion of the International Searching Authority, dated Jun. 10, 2016, for International Application No. PCT/US2016/023937 (12 pgs.).

(Continued)

*Primary Examiner* — Thomas E Lazo
(74) *Attorney, Agent, or Firm* — Fitch, Even, Tabin & Flannery LLP

(57) ABSTRACT

Valve and/or port plates incorporating or formed entirely of ceramic can each be provided with a reinforcing band. The band, which can optionally be metal, can be placed around the plate to provide additional strength to the plate, thereby allowing for a reduction in the overall diameter and/or thickness of the plates and, thus, the use of less ceramic material. The band can hold the plate in compression and/or be glued to hold the band in place.

16 Claims, 4 Drawing Sheets

(56) References Cited

U.S. PATENT DOCUMENTS

| | | | | |
|---|---|---|---|---|
| 5,588,347 | A | 12/1996 | Jepsen | |
| 5,598,761 | A | 2/1997 | Kristensen | |
| 5,601,009 | A | 2/1997 | Jepsen | |
| 5,622,097 | A * | 4/1997 | Martensen | F04B 1/2021 74/60 |
| 5,671,653 | A | 9/1997 | Martensen | |
| 5,704,272 | A | 1/1998 | Durako | |
| 5,737,996 | A | 4/1998 | Hansen | |
| 5,752,428 | A * | 5/1998 | Jepsen | F03C 1/0647 417/269 |
| 5,758,566 | A | 6/1998 | Jepsen | |
| 5,762,477 | A | 6/1998 | Jepsen | |
| 5,778,757 | A | 7/1998 | Kristensen | |
| 5,784,951 | A | 7/1998 | Moller | |
| 5,794,513 | A | 8/1998 | Kristensen | |
| 5,813,315 | A | 9/1998 | Kristensen | |
| 5,868,061 | A | 2/1999 | Hansen | |
| 5,890,412 | A | 4/1999 | Martensen | |
| 5,947,003 | A | 9/1999 | Jepsen | |
| 6,000,316 | A | 12/1999 | Moller | |
| 6,217,289 | B1 | 4/2001 | Smith | |
| 6,405,634 | B1 * | 6/2002 | Hansen | F04B 1/2007 92/128 |
| 6,648,605 | B2 | 11/2003 | Nelson | |
| 7,052,246 | B1 | 5/2006 | Ploug | |
| 7,188,562 | B2 * | 3/2007 | Hansen | F04B 1/124 92/71 |
| 7,263,925 | B1 | 9/2007 | Hansen | |
| 7,540,720 | B2 * | 6/2009 | Enokijima | F04B 39/06 417/269 |
| 7,794,212 | B2 | 9/2010 | Hugelman | |
| 7,806,040 | B2 | 10/2010 | Peterson | |
| 7,862,307 | B2 | 1/2011 | Watanabe | |
| 2004/0216601 | A1 | 11/2004 | Matsumoto | |
| 2005/0180860 | A1 | 8/2005 | Dewispelaere | |
| 2005/0207905 | A1 | 9/2005 | Koelzer | |
| 2007/0022873 | A1 | 2/2007 | Sund | |
| 2007/0039157 | A1 | 2/2007 | Rateick | |
| 2009/0129949 | A1 | 5/2009 | Stoelzer | |
| 2010/0087930 | A1 | 4/2010 | Tuke | |
| 2010/0282070 | A1 | 11/2010 | Ishikawa | |
| 2013/0118346 | A1 | 5/2013 | MacHarg | |

FOREIGN PATENT DOCUMENTS

| | | |
|---|---|---|
| WO | 9522001 | 8/1995 |
| WO | 2016154395 A1 | 9/2016 |

OTHER PUBLICATIONS

International Search Report and Written Opinion, dated Mar. 26, 2013 for International Patent Application No. PCT/US2012/065609 (6 pgs.).

* cited by examiner

BANDED CERAMIC VALVE AND/OR PORT PLATE

FIELD

Valve and port plates having, such as those suitable for use in rotary axial piston pumps or pressure exchangers, are described herein and, in particular valve and port plates having ceramic interface surfaces.

BACKGROUND

Rotary axial piston pumps (RAPPs) are known in the art and can be constructed for a number of different end-use applications. One category of RAPPs are configured for use in applications, e.g., oil hydraulic transport, that permit the internal components that are subjected to friction to be oil lubricated, thereby helping to reduce the unwanted effects of friction to provide a desired service life. Another category of RAPPs are configured for use in applications, e.g., water hydraulic transport, that do not permit the internal components subjection to friction to be oil lubricated. In such applications, the RAPPs are configured to use plain water without additives or aides as the only friction lubricating medium.

Conventional RAPPs configured for water hydraulic transport service use internal parts, subjected to friction during use, that are specifically configured to include a polymeric low-friction surface feature. Such a conventional RAPPs comprise metallic valve and port plates that include a polymeric interface surfaces.

While such RAPPs are configured to address frictional wear effects between adjacent metallic parts during water hydraulic transport use, the use of such RAPPs configured in the manner described require that the water entering the pump be filtered to very high levels to remove particulate matter. If unfiltered to a sufficient degree, the particulate matter in the water can otherwise wear and/or damage polymeric surface feature resulting in metal-to-metal contact, thereby reducing the effective service life of the RAPP. The need to filter the water transported by the RAPPs to protect against unwanted damage and/or reduced service life involves using filtration equipment that adds labor and material costs to the overall cost of operating such RAPPs. Furthermore, wear can adversely impact the precision clearances relied upon for sealing, and can thereby result in loss in pump efficiency and flow.

Thus, while RAPPs configured for water transport service are constructed to provide some degree of low friction operation under certain operating conditions, e.g., ultra-clean conditions, it is desired that an RAPP be constructed in a manner that permits a more robust operating parameters in water transport services in terms of both improved service life and in terms of reduced water pretreatment requirements. Specifically, it is desired that an RAPP be constructed in a manner comprising internal parts specially developed and engineered to provide an improved degree of friction reduction performance, thereby extending service life when compared to conventional water transport RAPPs.

It is further desired that such RAPPs comprising such construction provide the improved degree of friction reduction performance in a manner that avoids the need to filter the incoming water to ultra-fine standards, thereby reducing the overall equipment and labor costs associated with RAPP operation. Finally, it is desired that such RAPP be constructed in a manner avoiding the use of exotic materials and/or nonconventional manufacturing techniques, thereby minimizing any such impact on material and manufacturing costs.

One solution to the aforementioned problem is to use ceramic valve and port plates. Ceramic valve and port plates can advantageously reduce wear and erosion while being manufactured with the precise tolerances, and can be particularly suitable for use in water-lubricated pumps. The ceramic valve and port plates can be used in RAPPs as well as pressure exchangers, for example. However, ceramic can be expensive as compared to metal components, and can fracture.

SUMMARY

In order to improve the resistance to fracturing as well as reduce the costs associated with the use of ceramic materials, valve and/or port plates can each be provided with a reinforcing band. The band, which can optionally be metal, can be placed around the plate. The band serves two purposes. One is provide additional strength to the plate, thereby allowing for a reduction in the overall diameter and/or thickness of the plates. The end result is that less ceramic material can translate into a cost savings. The other is to hold the plate together in case of a failure, such as a crack. This can eliminate or at least reduce the spread of debris throughout the pump. The band can hold the plate in compression. This can be accomplished by applying a heated band around a relatively cool ceramic plate, then allowing the heated band to cool and contract to place the ceramic plate in compression. Alternatively, the band could be glued to the ceramic plate.

The banded ceramic valve and/or port plates described herein can be incorporated into RAPPs, pressure exchangers or other suitable devices. An exemplary RAPP, such as that disclosed in U.S. Publ. Appl. No. 2013/0118346, which is hereby incorporated by reference in its entirety, can comprise a housing, a swash plate that includes an inclined surface, and a rotor assembly that is positioned adjacent the swash plate. The rotor assembly comprises a rotor-drum that has at least one cylinder bore disposed therein, and that has piston(s) disposed within the respective cylinder bore(s). The pistons are constructed having a ball-shaped end that extends from the cylinder bore(s). At least one slipper is interposed between the swash plate and the rotor-drum. The slipper(s) comprises socket joints for accommodating the piston ball-shaped end(s) therein. The port plate is positioned adjacent an end block that is disposed in the housing open end, and the valve plate that is interposed between the port plate and the rotor-drum. In an exemplary embodiment, the port plate comprises an interface surface that is in contact with the valve plate, and that is formed from ceramic material. In another exemplary embodiment, the valve plate comprises an interface surface that is in contact with the port plate, and that is formed from a ceramic material. In yet another exemplary embodiment, both the valve and port plates have ceramic interface surfaces. In another exemplary embodiment, the port plate and/or the valve plate may be formed entirely from a ceramic material. Unlike the RAPP in the aforementioned publication, either or both of the plates can have the aforementioned reinforcing band. The band can either be disposed about the outer circumference of the plate, disposed radially inward relative to the outer circumference of the plate or more than one band can be provided with one band in each position.

In one aspect, a set of valve and port plates configured for use in a rotary axial piston pump or pressure exchanger are provided, wherein each of the plates includes a ceramic interface surface for rotatably sliding engagement with the other plate. A reinforcing band radially surrounds one of the ceramic interface surfaces to hold the surface in compression, which can be either the ceramic interface surface of the valve plate or the port plate. Each plate can have its own reinforcing band to hold its ceramic interface surface in compression. Each of the plates ca be ceramic and the reinforcing bands can surround the outer circumference of the plates or a radially inward portion thereof.

In another aspect, the plate or plates having the reinforcing band or bands can be incorporated into a RAPP, a pressure exchanger, or other device. In an exemplary aspect, the RAPP can include a housing, a swash plate having an inclined surface, and a rotor assembly positioned adjacent the swash plate. The rotor assembly can include a rotor-drum having at least one cylinder bore disposed therein, and having piston(s) disposed within the respective cylinder bore(s), wherein the pistons having a ball-shaped end extending from the cylinder bore(s). At least one slipper can be interposed between the swash plate and the rotor-drum. The slipper can have socket joints for accommodating the piston ball-shaped end(s) therein and a swash plate interface surface in contact with the swash plate inclined surface which swash plate interface can optionally be formed from a ceramic material. A port plate is positioned adjacent an end block disposed in the housing open end, and a valve plate interposed between the port plate and the rotor-drum. The port and valve plates each have a ceramic surface at an interface thereof. A reinforcing band is provided surrounding at least a portion, such as the outer circumference or a radially inward portion, of one of the plates, either the valve or port plate, to hold the plate in compression. A second such reinforcing band can be provided about at least a portion of the other of the plates. The band can optionally be formed of a metal.

In one aspect, the reinforcing band is disposed about the outer circumference of the one of the plates. In another aspect, the reinforcing band is disposed radially inward relative to an outer circumference of the plate. In yet another aspect, the reinforcing band is provided with one or more recessed pockets. Either or both of the plates can be formed of a ceramic material, as opposed to just the interface surfaces. Indeed, both plates can be ceramic and each can have their own reinforcing band.

DETAILED DESCRIPTION

Figure 1:
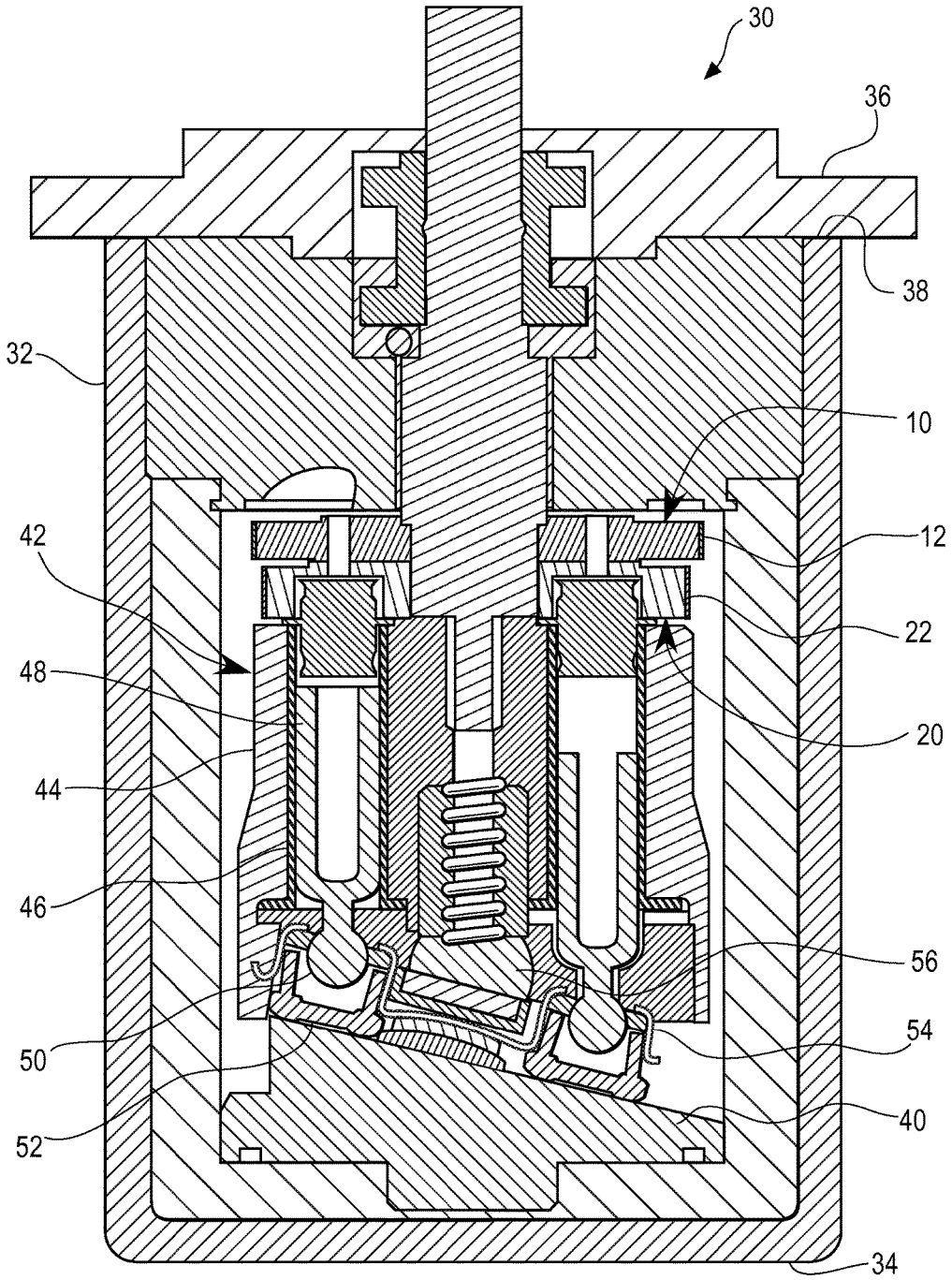
FIG. 1 illustrates a cross-sectional view of a RAPP where the RAPP incorporates a ceramic valve plate and a ceramic port plate, each with a metal reinforcing band.

In order to improve the resistance to fracturing as well as reduce the costs associated with the use of ceramic materials, valve and/or port plates can each be provided with a reinforcing band. The valve and/or port plates can be incorporated into a RAPP, pressure exchanger or other device. Although FIG. 1 depicts reinforced ceramic valve and port plates incorporated into a RAPP, it will be understood that such reinforced ceramic valve and port plates could alternatively be incorporated into numerous other machine designs, such as pressure exchangers and other valve systems.

Figure 2:
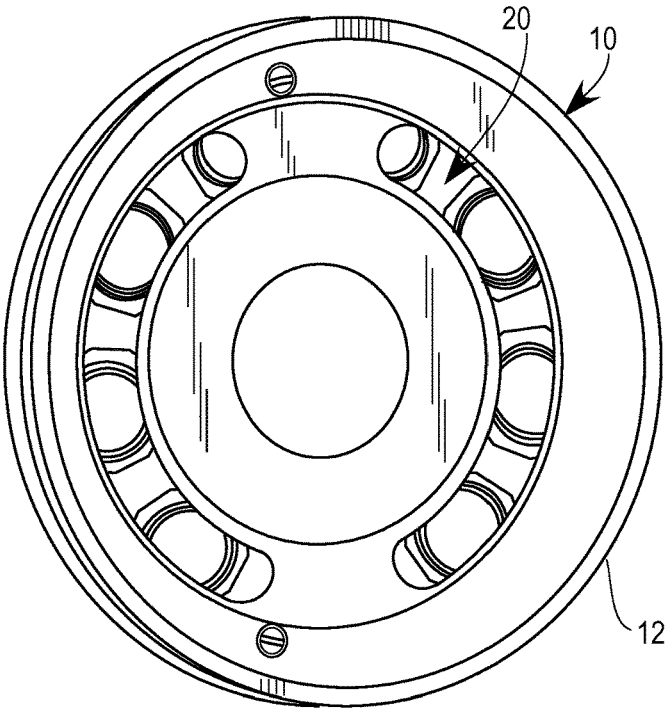
FIG. 2 is a front perspective view of a valve and port plate set having a band disposed about the circumference of each plate.
Figure 3:
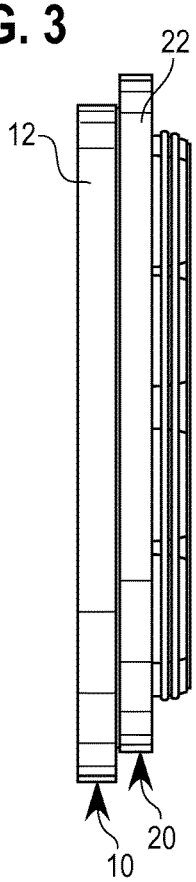
FIG. 3 is a side elevation view of the valve and port plate set of FIG. 2.
Figure 4:
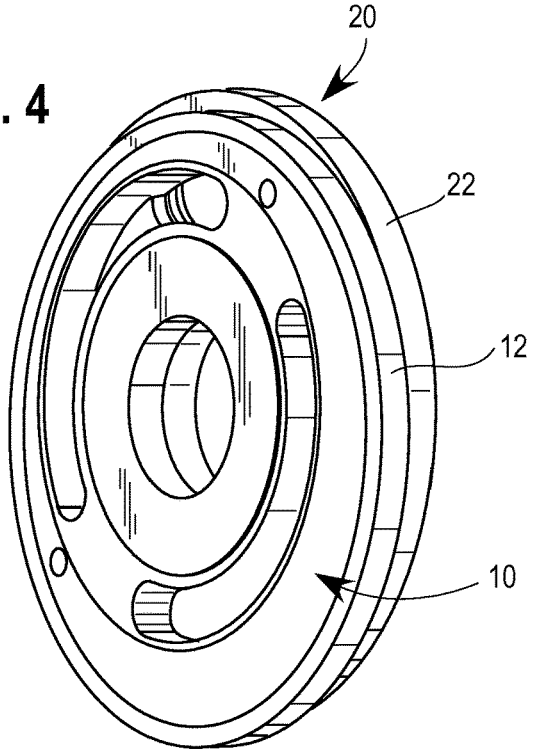
FIG. 4 is a rear perspective view of the valve and port plate assembly of FIG. 2.

The valve plate 10 and port plate 20 can be provided as part of a set, as shown in FIGS. 2-4, and each plate can have an outer surrounding metal band 12 or 22 disposed about the outer circumference of the plate or, alternatively or in addition, a radially inward metal bend. The valve plate 10 and port plate 20 can each be made entirely of ceramic or, at a minimum, have ceramic material disposed where the two plates 10 and 20 slide against each other when rotating relative to each other. The bands 12 and 22 can function to provide additional strength to the respective plates 10 and 20. This in turn can lead to reduced thickness and/or reduced diameter plates 10 and 20, which in turn can lead to less ceramic material, which in turn can lead to reduced cost plates. Furthermore, the use of the reinforcing bands 12 and 22 can eliminate or at least reduce fractures to the plates 10 and 20 from resulting in fragments becoming distributed elsewhere throughout the machinery.

Figure 7:
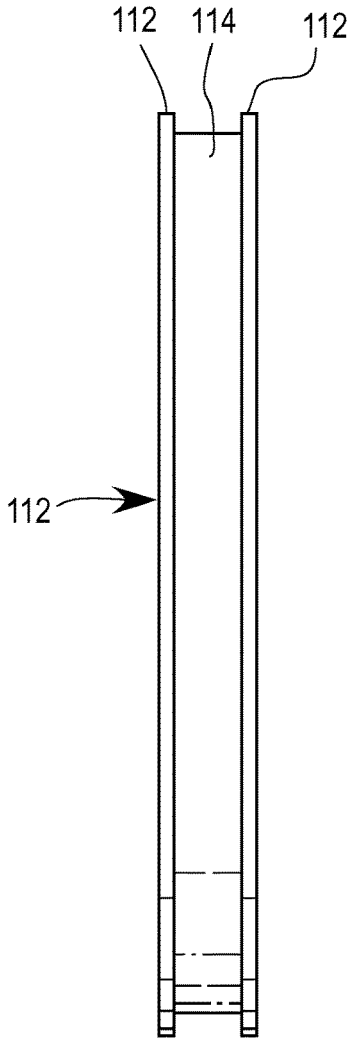
FIG. 7 is a side elevation view of a first alternative band for use with the valve and port plates of FIG. 2, where the band has a pair of rims or flanges and a recess therebetween.
Figure 8:
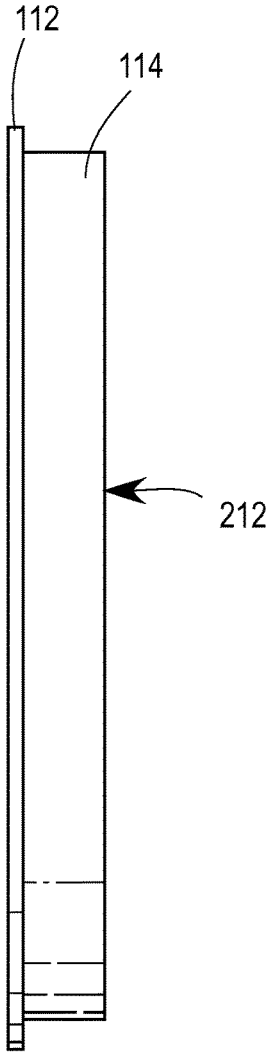
FIG. 8 is a side elevation view of a second alternative band for use with the valve and port plates of FIG. 2, wherein the band has a single rim or flange with a recess to the side thereof.

Turning now to details regarding the bands 12 and 22, they can be made of a metal, such as aluminum, stainless steel, carbon steel, or the like. The metal can be formed from a strip of material which is shaped into a hoop and then lap welded or, alternatively formed into a hoop by cutting using a lathe from stock metal pipe. The metal bands can have a thickness suitable for the application. In the example of a RAPP, the thickness can be between about 0.12 inches and about 0.50 inches. The metal bands can alternatively have a thickness than varies, such as by having one or more rims or flanges. For example, a first alternative band 110 for use with the valve and port plates is depicted in FIG. 7, where the band 110 has a pair of rims or flanges 112 projecting radially from the edges in order to form a recess or pocket 114 therebetween. A second alternative band 212 for use with the valve and port plates is depicted in FIG. 8, wherein the band 212 has a single rim or flange 112 projecting radially from an edge of the band with a recess or pocket 114 to the side thereof.

The plates 10 and 20 do not have to be specially modified to accommodate the bands 12 and 22, such as if they are made of a ceramic material. In such a case, and as illustrated in FIGS. 2-4, the metal bands 12 and 22 can be disposed about the outer circumference of each of the respective plates 10 and 20. They can be held in place using friction and, preferably though not necessarily, hold the plates 10 and 20 in compression. Such a friction and compression fit can be accomplished, for example, by heating the bands 12 and 22 so that they enlarge and can slip around the outer circumference of the respective plate 10 and 20. The plates 10 and 20 can optionally be cooled as well. Once the bands 12 and 22 contract, the friction fit and compression forces can result. Alternatively or in addition, glue can be used to hold the bands 12 and 22 in place. A hydraulic press can be used to slip the bands 12 and 22 around the outer circumference of the plates 10 and 20. While the plates 10 and 20 do not have to be specially modified to accommodate the bands 12 and 22, they could be so modified. For example, a groove could be formed to at least partially seat the bands, or protuberances could be formed that mate with apertures or recesses of the band.

Figure 5:
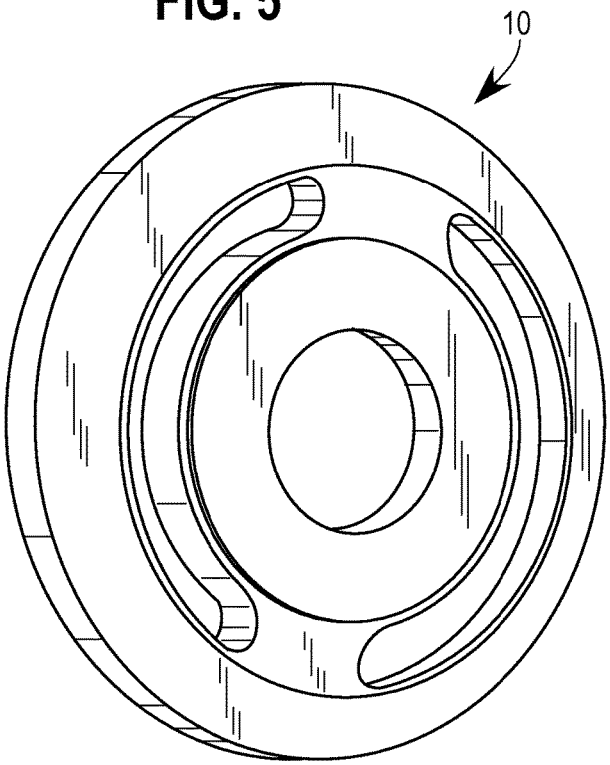
FIG. 5 is a front elevation view of the valve plate of FIG. 2 showing the interface surface.
Figure 6:
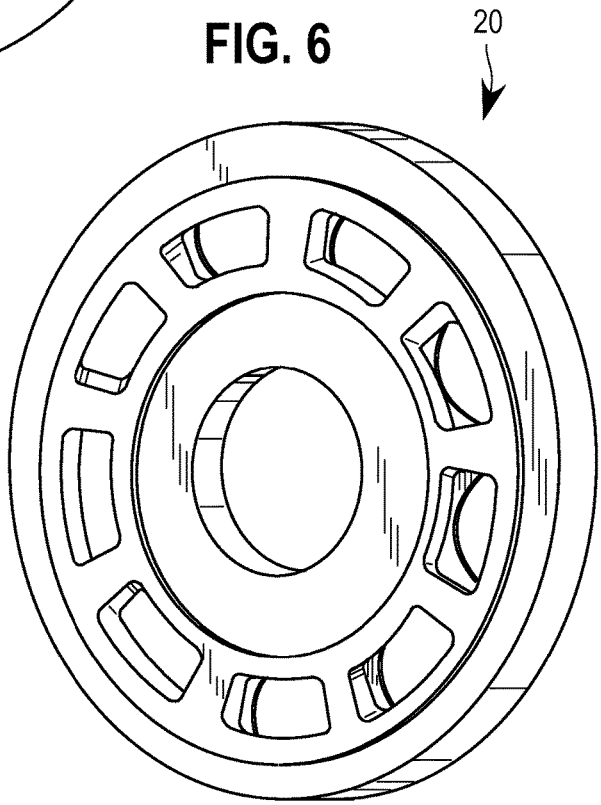
FIG. 6 is a rear elevation view of the port plate of FIG. 2 showing the interface surface.

Each of the plates 10 and 20 has an interface surface, shown in FIGS. 5 and 6, where they slidingly engage when rotated relative to each other during operation. While the entire plates 10 and 20 can be formed of ceramic, as an alternative at least those interface surfaces can be formed of ceramic material. Examples of suitable ceramic materials include metal oxides and metal carbides. Examples of preferred ceramic materials include but are not limited to aluminum oxide, silicon carbide, tungsten carbide and combinations thereof In the case of a composite construction, there may be a metal body having a ceramic layer (e.g., in the form of a veneer or the like) covering all or a portion of the interface surfaces. If desired, the layer can be provided in the form of a continuous surface or can be provided in the form of one or more surface features projecting outwardly a distance from the surface to contact the other plate plate. When the entire plate is not formed from a ceramic material, it is desired that such layer have a thickness that is sufficient to provide a desired degree of low-friction service to provide a desired effective service life without unnecessarily adding to the material costs. In an example embodiment, it is desired that the ceramic layer or ceramic surface feature have a thickness of at least 0.03 inches, and preferably in the range of from about 0.03 to 0.1 inches.

Turning now to a description of a RAPP 30, and with reference to FIG. 1, the RAPP 30 can incorporate a set of ceramic port and valve plates 20 and 10 each with a metal band 22 and 12. Instead of a set each with a band, one of the plates can include a band and the other may not. The RAPP 30 comprises a stator assembly including a housing 32 having a generally closed first end 34 at one axial end, and having an end block 36 attached to an otherwise opposed open end 38 of the housing 32. The valve plate 10 is disposed within the housing 32 and is positioned adjacent an inside surface of the end block 54. The valve plate 10 does not rotate relative to the housing 32. A swash plate 40 is disposed within the housing 32 and positioned adjacent an inside surface of the closed first end 34 of the housing 32. The swash plate 40 is a stationary member that does not rotate relative to the housing 3 and provides a smooth flat inclined surface that extends towards the port plate 20. A rotor assembly 42 is disposed within the housing and comprises a cylindrical rotor-drum 44 that is interposed between the port plate 20 and the swash plate 40. The rotor-drum 44 is configured to rotate within the housing 32 and comprises an array of axial cylinder bores 46, each fitted with an axial piston 48. Each axial piston 48 comprises a ball-shaped end 50 in swivel engagement with a slider shoe or slipper 52 held against the inclined surface of swash plate 40. The slipper 52 preferably, though not necessarily, comprises a ceramic body or at least a ceramic swash plate interface surface.

The slippers 52 are supported in a uniform array and held against swash plate 40 by a shoe pressure plate 54, which bears against the central region of rotor-drum 44 via a hemispherical swivel member 56. At the other end of rotor-drum, the attached valve plate 10 interfaces with the port plate 20 at a sliding interface to serve as a sliding valve control system. The port plate 20 rotates with the rotor-drum 44 within the housing 32.

The port plate 20 is configured having a number of openings there through, as shown in FIG. 7, that align with respective openings in the cylinder bores 46. The valve plate 10 also comprises openings, as shown in FIG. 5, that are in alignment with inlet and outlet ports (not shown) extending through the end block 36. As the rotor-drum 44 rotates within the housing 32, the port plate openings align with the valve openings to facilitate fluid inlet and outlet in a manner corresponding to the piston inlet and outlet strokes to provide the desired fluid transport by the RAPP 30.

Generally speaking, the internal components or parts of such RAPPs that are subjected to frictional forces during pump operation include the interface surfaces between the port plate 20 and the valve plate 10, the interface surfaces between the swash plate 40 and the piston slippers 52, and the interface between the piston ball-shaped end 50 and the slipper 52. When the RAPP is configured for use in oil hydraulic transport service, such interface surfaces are lubricated by the oil being transported, which operates to reduce the frictional forces existing at the metallic interfacing surfaces. However, when used for water transport, the water can provide lubrication.

The use of ceramic materials is not limited to the valve and port plates 10 and 20. Indeed, other parts can be formed of ceramic material for the purpose of reducing and controlling unwanted frictional effects between dynamically engaged surfaces. Depending on the particular internal part, the entire part can be formed from a ceramic material, or only a portion of the part can be formed from a ceramic material. For example, the slippers 52 and/or swash plate 40 can incorporate a ceramic material, as described in U.S. Publ. Appl. No. 2013/0118346.

The banded ceramic valve and port plates, as well as the RAPPs incorporating the same, as disclosed herein may be embodied and practiced in other specific forms without departing from the spirit and essential characteristics thereof. The present embodiments disclosed and illustrated herein are therefore to be considered in all respects as illustrative and not restrictive.

The invention claimed is:

1. A rotary axial piston pump comprising:

a housing;

a swash plate, the swash plate having an inclined surface;

a rotor assembly positioned adjacent the swash plate, the rotor assembly comprising a rotor-drum having at least one cylinder bore disposed therein, and having piston(s) disposed within the respective cylinder bore(s), the pistons having a ball-shaped end extending from the cylinder bore(s);

at least one slipper interposed between the swash plate and the rotor-drum, the slipper(s) comprising socket joints for accommodating the piston ball-shaped end(s) therein, the slipper(s) having a swash plate interface surface in contact with the swash plate inclined surface and optionally formed from a ceramic material;

a port plate positioned adjacent an end block disposed in the housing open end; and a valve plate interposed between the port plate and the rotor-drum;

wherein the port and valve plates each have a ceramic surface at an interface thereof; and wherein a reinforcing band is provided surrounding at least a portion of one of the plates to hold the plate in compression.

2. The rotary axial piston pump of claim 1, wherein the reinforcing band is provided surrounding the valve plate.

3. The rotary axial piston pump of claim 1, wherein the reinforcing band is provided surrounding the port plate.

4. The rotary axial piston pump of claim 1, wherein the reinforcing band is provided surrounding the valve plate and a second reinforcing band is provided surrounding the port plate to hold the port plate in compression.

5. The rotary axial piston pump of claim 1, wherein the reinforcing band is metal.

6. The rotary axial piston pump of claim 1, wherein the reinforcing band is disposed about the outer circumference of the one of the plates.

7. The rotary axial piston pump of claim 1, wherein the one of the plates is ceramic, and the reinforcing band is disposed radially inward relative to an outer circumference of the plate.

8. The rotary axial piston pump of claim 7, wherein the reinforcing band is provided with a recess.

9. The rotary axial piston pump of claim 1, wherein the one of the plates is ceramic.

10. The rotary axial piston pump of claim 1, wherein both plates are ceramic and wherein the reinforcing band is provided surrounding the valve plate and a second reinforcing band is provided surrounding the port plate to hold the port plate in compression.

11. A set of valve and port plates, wherein each of the plates includes a ceramic interface surface for rotatably sliding engagement with the other plate, further comprising a reinforcing band radially surrounding one of the ceramic interface surfaces to hold the surface in compression.

12. The set of valve and port plates of claim 11, wherein the reinforcing band radially surrounds the ceramic interface surface of the valve plate.

13. The set of valve and port plates of claim 11, wherein the reinforcing band radially surrounds the ceramic interface surface of the port plate.

14. The set of valve and port plates of claim 11, wherein the reinforcing band radially surrounds the ceramic interface surface of the valve plate and a second reinforcing band radially surrounds the ceramic interface surface of the port plate to hold the surface in compression.

15. The set of valve and port plates of claim 11, wherein each of the plates is ceramic and the reinforcing bands surround the outer circumference of the plates.

16. The set of valve and port plates of claim 11, wherein the plates are suitable for use in either a rotary axial piston pump or pressure exchanger.

* * * * *